United States Patent [19]

Job

[11] Patent Number: 4,796,710

[45] Date of Patent: Jan. 10, 1989

[54] GLASS BULB FOR SPRINKLER HEADS

[76] Inventor: Eduard J. Job, Hansdorfer Strasse 14, 2070 Ahrensburg, Hamburg, Fed. Rep. of Germany

[21] Appl. No.: 904,158

[22] Filed: Sep. 5, 1986

[30] Foreign Application Priority Data

Sep. 9, 1985 [DE] Fed. Rep. of Germany ..... 3532042

[51] Int. Cl.[4] ..... A62C 37/08

[52] U.S. Cl. ..... 169/38; 169/37

[58] Field of Search ..... 169/37, 38, 39, 40, 169/41, 42, 19

[56] References Cited

U.S. PATENT DOCUMENTS

| | | | |
|---|---|---|---|
| 431,972 | 7/1890 | Grinnell | 169/38 |
| 793,367 | 6/1905 | Diederici | 169/38 |
| 842,725 | 1/1907 | Taylor | 169/38 |
| 1,199,087 | 9/1916 | Loepsinger | 169/38 X |
| 1,733,701 | 10/1929 | Taylor | 169/38 |
| 1,797,919 | 3/1931 | Loepsinger | 169/38 |
| 1,996,077 | 4/1935 | Loepsinger | 169/38 |
| 2,085,987 | 7/1937 | Loepsinger | 169/38 |
| 2,861,805 | 12/1953 | Lim | 169/38 |
| 3,253,657 | 5/1966 | Job | 169/38 |
| 4,109,727 | 8/1978 | Job | 169/41 |
| 4,167,974 | 9/1979 | Job | 169/38 |
| 4,609,047 | 9/1986 | Piecyzkolan | 169/38 |
| 4,619,327 | 10/1986 | Piecyzkolan | 169/38 |

FOREIGN PATENT DOCUMENTS

| | | | |
|---|---|---|---|
| 301618 | 10/1919 | Fed. Rep. of Germany . | |
| 731445 | 1/1943 | Fed. Rep. of Germany | 169/38 |
| 867654 | 2/1953 | Fed. Rep. of Germany . | |
| 2019817 | 12/1970 | Fed. Rep. of Germany . | |
| 2118790 | 11/1972 | Fed. Rep. of Germany . | |
| 2206993 | 8/1973 | Fed. Rep. of Germany . | |
| 208424 | 12/1923 | United Kingdom | 169/38 |
| 258791 | 9/1926 | United Kingdom | 169/38 |
| 1118526 | 7/1968 | United Kingdom . | |
| 1322179 | 7/1973 | United Kingdom | 169/38 |
| 1349935 | 4/1974 | United Kingdom . | |
| 1350991 | 4/1974 | United Kingdom . | |
| 1582360 | 1/1981 | United Kingdom . | |
| 1595116 | 8/1981 | United Kingdom . | |
| 2120934 | 12/1983 | United Kingdom . | |

OTHER PUBLICATIONS

Sprinkler Bulbs, Inc., Information Sheets and Drawings, 109 Waynewood Avenue, Wayne, Pa. 19687, 9/1985.

*Primary Examiner*—Sherman D. Basinger
*Assistant Examiner*—Paul E. Salmon
*Attorney, Agent, or Firm*—Palmatier & Sjoquist

[57] ABSTRACT

An improved thermally active glass bulb for fire extinguisher sprinkler heads. The elongate bulb has a one piece integrally formed glass envelope which is of circular shape and has end portion and a tubular column therebetween defining an elongate sealed chamber containing a heat responsive expansible liquid to rupture the glass envelope when heat is sensed. The bulb has an elongate tapered end tip formed in loading and sealing of a quantity of the expansible breaking liquid into the chamber. The end portions are adapted for seating in the sprinkler head and have outer peripheries smoothly tapering divergently progressively endways from portions of the tubular column and toward the seating areas. The end portions having diameters in excess of a diameter of the tubular column.

14 Claims, 2 Drawing Sheets

GLASS BULB FOR SPRINKLER HEADS

This invention relates to a thermally responsive glass bulb which responds to increased temperatures for use in fire extinguishing sprinkler systems and the like or in other thermal release means.

BACKGROUND OF THE INVENTION

In sprinklers, which constitute the main field of use for glass bulbs, such bulbs act as the thermally active release member to keep a valve closed. The elongate bulb is generally secured at its ends between two abutments of the sprinkler and such abutments apply a force or mechanical load endways or axially of the elongate bulb. In the case of a fire, the glass bulb shatters and frees the valve to open and to release the fire extinguishing medium, which is usually water.

Such a glass bulb typically comprises a hollow and generally cylindrical or barrel shaped enclose or shaft, the length of which may vary widely. The bulb is often provided with an annular offset or shoulder in the wall at one end of the shaft so as to form the actual thermally active part together with the expansible breaking fluid or liquid confined within the glass enclosure. At the ends, which engage sprinkler abutments, the shaft is bounded by flat, conical or curved, substantially thermally inactive ends. One of the ends is normally referred to as the tip end, which is thin and tapered to a rounded point. The expansible breaking fluid is introduced into the bulb through the tip end during manufacturing, and thereafter the tip end is closed.

The glass bulb must be able to take a specific permanent load which is dependent upon the nature of the valve construction or release mechanism in the sprinkler as to insure that the sprinkler remains reliably closed over several decades and is always kept in a state of readiness.

Previously known glass bulbs which satisfy the appropriate standards imposed by insurance or governmental agencies, generally have a diameter between 8 and 12 mm, a wall thickness of 1 to 1.5 mm, and an overall length of 20 to 30 mm. Such relatively thick glass bulbs do not respond quickly to the application of heat from a fire, but have rather long release times, i.e., the time lapse from the first occurrence of critical temperature to be sensed to the shattering of the bulb and release of the valve. Such long release times are a result of the unfavorable ratio of the heat-absorbing surface of the bulb to the volume within the bulb to be heated. A spherical glass bulb in this respect indicates the least favorable shape.

The commercial market demands regarding glass bulbs for sprinklers for automatic fire extinguisher systems and also for other thermal release means, are for much shorter release times, which may be up to almost ten times shorter. Such shorter release times must be achieved without sacrificing durability of the glass drum to axial loading in the sprinkler.

One prior proposal to meet these requirements consisted of reducing the volume of breaking liquid in the glass bulb by placing a solid displacement member in the bulb without modifying the dimensions of the glass body, and therefore without modifying the strength characteristics. See U.K. Patent No. 2,120,934, published Dec. 14, 1983. Attempts have also been made to reduce the release times by reducing the overall diameter of glass drum so as to bring about a more favorable ratio of the surface area to the volume of the bulb, and consequently of the volume of the breaking liquid in the bulb. However, these attempts have lead to an unacceptable reduction in strength.

SUMMARY OF THE INVENTION

An object of the present invention is to provide a thermally responsive glass bulb for sprinklers and the like which, without any significant loss in strength and durability, is capable of meeting strict standards of response to critical temperatures as to fracture or rupture in the case of a fire, and which can also be economically manufactured.

A feature of the invention is an improvement in the construction of the glass envelope of the bulb as to strengthen the bulb against endways loading so that the diameter of the shaft or column of the bulb may be substantially reduced, thereby substantially reducing the ratio of the volume within the shaft or column to its outer surface area, which thereby permits the quantity of expansible breaking liquid to be reduced. The strength of the glass envelope is significantly improved by increasing the outer diameter and the thickness of the glass at the end of the column or shaft adjacent the end of the bulb.

In order to obtain maximum improvement in the strength, both ends of the glass envelope will be similarly strengthened, but some improvements in strength can already be obtained by increasing the strength of the glass only adjacent the tip end of the envelope.

More specifically, the outer diameter of the bulb is increased and thickness of the glass is increased at the end of the shaft adjacent the tip end. The shaft or column of the glass envelope is progressively, smoothly and divergently tapered at its outer periphery in a direction toward the strengthened part of the envelope. At the end portions of the envelope a seating area or zone is provided with a shape to suitably engage and bear heavily against the abutment or seat of the sprinkler. Usually the seating area is tapered convergently toward the slender tip or terminal end of the glass envelope with a uniform or varying taper as to be somewhat dome shaped, or nearly spherically shaped, or the seating zone or area may be otherwise shaped. The increased thickness of glass extends from the shaft or column to the location of the seating area which bears against the seat of the sprinkler.

By progressively increasing the diameter of the outer periphery toward the end of the glass bulb; and by increasing the thickness of the glass adjacent the tapering outer periphery, the elongate tubular column or shaft of the glass bulb may be reduced in diameter, thereby improving the thermal responsiveness of the glass bulb without increasing the overall diameter of the bulb and without increasing the diameter of the seating areas as compared to prior bulbs.

DETAILED SPECIFICATION

Figure 1:
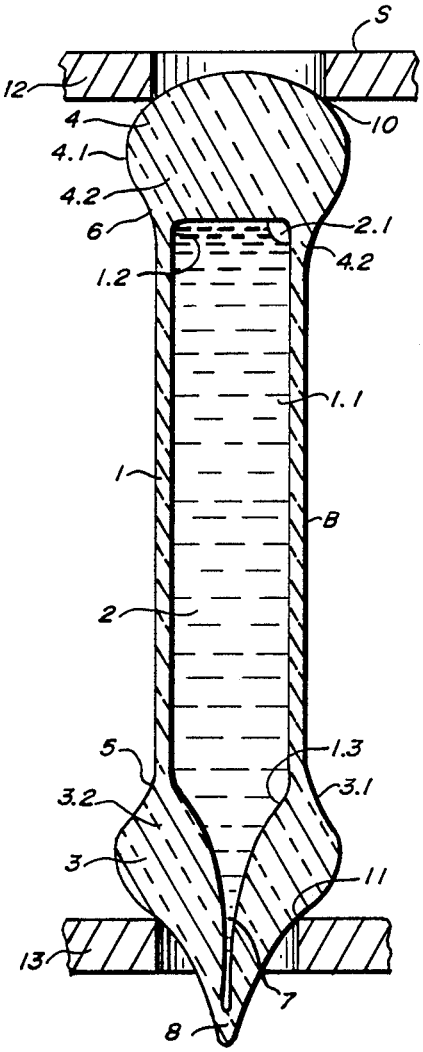
FIG. 1 is a sectional view of a glass bulb according to the present invention.

A preferred form of the glass bulb is illustrated in FIG. 1 and is indicated in general by the letter B.

The bulb B is particularly adapted for use in a sprinkler head indicated by the letter S and having seats 12 and 13 which engage and exert significant force in an endwise direction against the ends of the bulb B. One of the seats is connected with and stationary with the frame of the sprinkler head, and the other of the seats is connected with the valve element of the sprinkler head so that the valve will be released when the bulb is ruptured or broken due to its responsiveness to increased temperatures.

The bulb B has an elongate tubular column or shaft 1 which, in the form illustrated, is substantially cylindrical. The one piece integrally formed glass envelope which includes the column 1 and the end portions 3, 4 defines an interior sealed chamber 1.1 which is filled with thermally responsive expansible breaking liquid 2, the nature of which is well known to a person skilled in the art. The liquid 2 will have a small bubble 2.1.

At the end portions 3, 4 of the glass envelope, the outer peripheries 3.1, 4.1 taper divergently in an endways direction, away from the column 1 and endways toward the terminal ends of the glass envelope. At the end portions 3, 4 the thickness of the glass, inwardly of the outer peripheries 3.1, 4.1 is increased as to strengthen the glass envelope as at 3.2, 4.2. It will be recognized that the inner periphery of the sealed chamber 1.1 is cylindrical, slightly tapered or rounded at 1.2, adjacent the end portion 4 and is tapered convergently at 1.3 adjacent the end portion 3 as to cooperate with the divergently tapering outer peripheries 3.1, 4.1 to increase the thickness of the glass.

It will be recognized that in the transition zones 5, 6, the outer peripheries 3.1, 4.1 are very smoothly shaped and taper divergently to a larger circumference.

As illustrated, the outer peripheries 3.1, 4.1 have varying rates of taper so as to smoothly merge into the outer periphery of the tubular column or shaft 1, and to also smoothly merge into the peripheries of the enlarged end portions 3, 4. It will be recognized that the outer peripheries 3.1, 4.1 taper divergently from portions of the tubular column 1. As illustrated, the outer periphery 4.1 adjoining the enlarged tapering end 4 of the bulb, tapers in both endways directions from the adjacent end of the chamber 2; and the periphery 4.1 tapers convergently in one direction toward the tubular column 1 and tapers divergently toward the end 4, from the end of the chamber 2.

The outer periphery of the bulb B as a whole is circular, as is the inner periphery of the tubular column 1.

The increased outer diameter of the glass envelope adjacent the end portions, and the thickened glass inwardly of the periphery adjacent the end portions minimize the occurrence of shearing and tensile stresses in response to loads exerted endways by the seats, 12, 13 of the sprinkler head; and instead of the unfavorable shearing and tensile stresses, compressive stresses are primarily found in the glass envelope of the bulb. Because of this favorable stress condition which can be withstood by glass, the diameter of the tubular column 1 can be considerably smaller than the maximum diameters at the opposite end portions, 3, 4.

The end portion 3 of the glass envelope defines a narrow capillary 7 connected with the sealed chamber 1.1; and the end portion defines a sealed tip 8 which closes the capillary 7 after the chamber is filled with liquid through the capillary 7, after which the tip end 8 is closed off as to seal the capillary and the chamber.

Each of the end portions 3, 4 has seating areas 10, 11 for engaging the seats 12, 13. The seating areas 10, 11 face endways of the elongate bulb and may be variously shaped to accommodate the seats 12, 13 of the sprinkler head. It is seen that the seating area 10 is somewhat spherical; whereas the seating area 11 is tapered and somewhat conical so as to properly seat in the openings in the seats 12, 13.

As an example, the glass envelope of the bulb B may have a length of approximately 25 mm, a distance between the seating or bearing surfaces 10, 11 of approximately 20 mm. The tubular column 1 may be approximately 15 mm in length and have an external diameter of approximately 4 mm. The external diameter of the widest part of the end portions 3, 4 may be approximately 5 mm.

It has been experienced that the glass bulb with the divergently tapered outer peripheries at its end portions and with the increased thicknesses in the end portions as illustrated in FIG. 1, has a substantially greater strength in axial loading as compared to prior glass bulbs without the flared or divergently tapered end portions. In comparing the bulb of FIG. 1 to a similar prior bulb without the unique end portions as illustrated, but with a tubular envelope of similar outside diameter, the bulb illustrated in FIG. 1 was approximately four times stronger than the prior bulbs.

It has also been experienced that as compared to conventional glass bulbs with a diameter of 8 mm to 10 mm and approximately the same strength as the bulb of FIG. 1, the release time of the bulb as illustrated in FIG. 1 was approximately 1/5 of the release time of the prior bulb. Bulbs constructed according to FIG. 1 have been made and successfully tested with a diameter of less than 2 mm at the tubular column 1.

Figure 2:
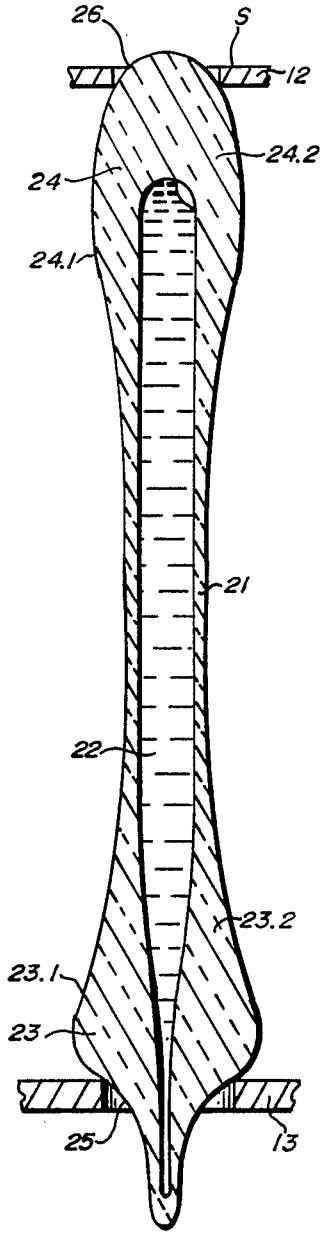
FIG. 2 is a modified form of glass bulb, also made in accordance with the present invention.

In the form of bulb illustrated in FIG. 2, the construction is similar to that of the bulb in FIG. 1. In FIG. 2, the glass is the thinnest in the tubular column 21 and the tubular column 21 has a reduced diameter so as to decrease the ratio of the outer surface area to the volume of the sealed chamber 22. The end portions 23, 24 have tapered outer peripheries 23.1, 24.1 which extend along a substantial portion of the sealed chamber 22. As in FIG. 1, the glass envelope is thickened, inwardly of the tapered peripheries 23.1, 24.1, as at 23.2, 24.2. The end portions of the bulb in FIG. 2 define the seating areas 25, 26 to engage and bear against the seats 12, 13 of the sprinkler head S.

As in FIG. 1, the increased thickness and increase in diameter of the end portions of the bulb minimize the existence in the bulb of the shearing and tensile stresses and accommodate the compressive stresses exerted endwise o the bulb by the seats of the sprinkler head.

Also as illustrated, and as in FIG. 1, the peripheries 23.1, 24.1 have varying rates of taper endways from portions of the tubular column 21 to the end portions 23, 24. As in FIG. 1, the outer periphery 24.1 tapers in both endways directions from the adjacent end of the chamber 22.

Figure 3:
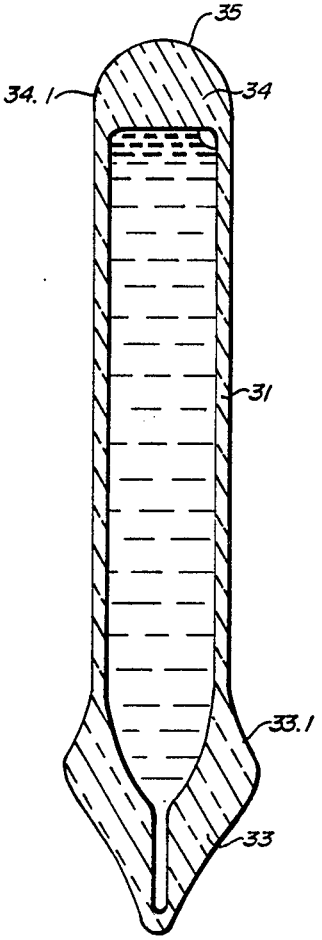
FIG. 3 is a further modified form of a glass bulb, also made in accordance with the present invention.

In the form illustrated in FIG. 3, the tubular column 31 is substantially cylindrical, and the end portion 34 has a truly spherical seating area 35 for bearing against the sprinkler seat. In this form, only the end portion 33 has the divergently tapered outer periphery 33.1 whereas the outer periphery 34.1 of the end portion 34 is uniformly cylindrical as it merges into the spherical surface which defines the seating area 35. This form of glass bulb illustrated in FIG. 3 experiences greater strength than prior art bulbs, but somewhat less strength than the forms illustrated in FIGS. 1 and 2.

As illustrated and as in FIG. 1, the outer periphery 33.1 has varying rates of taper and tapers divergently from portions of the tubular column 31.

I claim:

1. An elongate thermally responsive glass bulb to carry a mechanical load applied endways between opposing seats of a sprinkler head or the like, comprising, an elongate one piece glass envelope having integrally formed end portions and a tubular column therebetween and defining an elongate sealed chamber, the elongate envelope including an elongate tapered end tip extending endways of the elongate envelope, and a quantity of expansible breaking liquid substantially filling said sealed chamber and being responsive to increased temperatures to rupture the glass envelope at said tubular column, said end portions having endways facing seating areas for engaging the sprinkler head seats, one end portion of the envelope having an outer periphery smoothly tapering divergently progressively endways from a portion of the tubular column and toward the seating area, said one end portion having a diameter in excess of a diameter of the tubular column, said one end portion having a thickness of glass inwardly of said tapering outer periphery to the sealed chamber, said thickness smoothly increasing to larger dimension also progressively endways toward the seating area.

2. A glass bulb according to claim 1 and said one end portion including said tapered end tip.

3. A glass bulb according to claim 1 and said one end portion being opposite said tapered end tip.

4. A glass bulb according to claim 1 wherein the envelope has said tapering outer periphery and said increasing thickness at both end portions of the envelope.

5. A glass bulb according to claim 1 wherein the outer periphery has a varying rate of divergent taper.

6. A glass bulb according to claim 1 wherein the envelope has a circular cross section.

7. A glass bulb according to claim 1 wherein the tubular column has an inner periphery extending along said outer periphery, the inner periphery tapering convergently and the outer periphery tapering divergently in the same endwise direction whereby to progressively increase said thickness.

8. A glass bulb according to claim 1 wherein the tubular column has an inner periphery extending along said outer periphery, the inner periphery being substantially cylindrical along the divergently tapering outer periphery whereby to progressively increase the thickness.

9. A glass bulb according to claim 1 wherein said chamber has an end, said tapering outer periphery extending in both directions and both endways directions from the end of the chamber.

10. A glass bulb according to claim 1 wherein said chamber has an end adjacent the end tip of the envelope, the chamber extending into the end tip, said seating area being located endways between the end of the chamber and the tapering outer periphery.

11. A glass bulb according to claim 1 and the outer periphery also extending endways and convergently toward and entirely to said seating area.

12. A glass bulb according to claim 1 wherein said tapering periphery extends along a portion of the column.

13. A glass bulb according to claim 1 wherein one of said seating areas is substantially spherical in shape.

14. An elongate thermally responsive glass bulb to carry a mechanical load applied endways between opposing seats of a sprinkler head or the like, comprising an elongate one piece glass envelope having integrally formed end portions and a tubular column therebetween and defining an elongate sealed chamber, the elongate envelope including an elongate tapered end tip extending endways of the elongate envelope, and a quantity of expansible breaking liquid substantially filling said sealed chamber and being responsive to increased temperatures to rupture the glass envelope at said tubular column, said end portions having endways facing seating areas for engaging the sprinkler head seats, said end portions having outer peripheries smoothly tapering divergently progressively endways from portions of the tubular column and toward the seating areas, each end portion having a diameter in excess of the diameter of the tubular column, one end portion having a tapered tip and the other end portion being substantially dome shaped, said one end portion adjacent the tapered tip having a thickness of glass inwardly of said tapering outer periphery to the sealed chamber, said thickness smoothly increasing to larger dimension also progressively from portions of the tubular column and endways toward the respective end portion seating area.

* * * * *